United States Patent [19]

Morohashi et al.

[11] Patent Number: 4,876,478

[45] Date of Patent: Oct. 24, 1989

[54] CATHODE RAY TUBE APPARATUS WITH IMPROVED DEFLECTION UNIT

[75] Inventors: Katsuei Morohashi, Saitama; Jiro Shimokobe, Fukaya; Taketoshi Shimoma, Isesaki, all of Japan

[73] Assignee: Kabushiki Kaisha Toshiba, Kawasaki, Japan

[21] Appl. No.: 168,201

[22] Filed: Mar. 15, 1988

[30] Foreign Application Priority Data

Mar. 16, 1987 [JP] Japan ..... 62-58913
Mar. 17, 1987 [JP] Japan ..... 62-59982

[51] Int. Cl.[4] ..... H01J 29/56; H01J 29/76

[52] U.S. Cl. ..... 313/413; 313/414; 313/431; 313/440; 335/210

[58] Field of Search ..... 313/413, 440, 414, 421, 313/428, 431; 335/210, 211, 213

[56] References Cited

U.S. PATENT DOCUMENTS 4,041,428 8/1977 Kikuchi et al. ..... 335/210
4,415,831 11/1983 Konosu ..... 313/440 X

FOREIGN PATENT DOCUMENTS 57-38545 3/1982 Japan .
57-145254 9/1982 Japan .
61-292839 12/1986 Japan .
61-292840 12/1986 Japan .

*Primary Examiner*—Kenneth Wieder
*Attorney, Agent, or Firm*—Cushman, Darby & Cushman

[57] ABSTRACT

In a color cathode ray tube, electron beams generated from an electron gun assembly of an in-line type are deflected by horizontal and vertical deflection magnetic fields. The horizontal deflection magnetic field includes a main magnetic field and an auxiliary magnetic field. The main magnetic field has a barrel-shaped distribution and is substantially symmetrically formed about a Y-Z plane and the auxiliary magnetic field is substantially antisymmetric about the Y-Z plane.

4 Claims, 9 Drawing Sheets

CATHODE RAY TUBE APPARATUS WITH IMPROVED DEFLECTION UNIT

BACKGROUND OF THE INVENTION

1. Field of the Invention

The present invention relates to a color cathode ray tube apparatus having an in-line type electron gun assembly and, more particularly, to an in-line type color cathode ray tube apparatus having a deflection unit.

2. Description of the Related Art

In an in-line type color cathode ray tube apparatus, an envelope is constituted by a panel, a neck, and a funnel connected between the panel and neck. A phosphor screen is formed on an inner surface of the panel upon deposition of phosphor stripe layers for emitting red, green, and blue light rays. An electron gun assembly for emitting three electron beams toward this phosphor screen is arranged in the neck. A deflection magnetic field generator is mounted on an outer surface of the funnel to horizontally and vertically deflect electron beams emitted from the electron gun assembly so that the phosphor screen is properly scanned by the electron beams. In addition, a shadow mask is arranged near the phosphor screen so as to oppose the inner surface of the panel. A large number of apertures are formed in the shadow mask in a predetermined arrangement such that electron beams passing through the apertures are accurately landed on three phosphor strips.

In order to cause three electron beams generated from the electron gun assembly to be accurately converged on a convergent point near the phosphor screen and accurately landed on three corresponding phosphor strips or dots, the deflection unit produces a pincushion-shaped horizontal deflection magnetic field and a barrel-shaped vertical deflection magnetic field inside the funnel. That is, the deflection unit produces a self-convergence type magnetic field.

A cathode ray tube using such a self-convergence type magnetic field as a deflection magnetic field has many advantages, e.g., various terminals for convergence adjustment or a convergence circuit can be omitted. However, in the cathode ray tube using the self-convergence type magnetic field, since distortion of a magnetic field is utilized for convergence, the shape of electron beams is distorted on the phosphor screen, thereby degrading the resolution in a color picture tube. More specifically, as shown in FIG. 1A, in an end portion area on the phosphor screen along its horizontal axis, an electron beam spot is separated into horizontally elongated bright core portion 1 and vertically elongated dark halo portion 2 to be formed into a distorted shape. In an end portion area on the phosphor screen along its vertical axis, the electron beam spot is separated into vertically elongated small bright core portion 3 and vertically elongated large dark halo portion 4 to be formed into distorted shape.

SUMMARY OF THE INVENTION

It is an object of the present invention to provide an in-line type cathode ray tube apparatus, in which distortion of deflected electron beams is minimized and resolution is further improved.

According to the present invention, there is provided a color cathode ray tube apparatus comprising:

an evacuated envelope having tube axis Z;

a phosphor screen formed in the envelope, tube axis Z passing through a enter of the phosphor screen, and the phosphor screen having horizontal and vertical axes X and Y orthogonal to tube axis Z;

an electron gun assembly of an in-line type arranged in the evacuated envelope, for emitting a central beam, and side beams, toward the phosphor screen, the electron beams being landed on the phosphor screen to cause the phosphor screen to emit light rays; and deflection magnetic field generating means, arranged outside the evacuated envelope, for generating horizontal and vertical deflection magnetic fields inside the envelope so as to horizontally and vertically deflect the electron beams and scan the phosphor screen with the electron beams, the horizontal deflection magnetic field including a main deflection magnetic field having a barrel-shaped distribution and composed of a vertical component formed in the envelope so as to be symmetrical about a Y-Z plane including Y- and Z-axes and extend along the Y-axis, and an auxiliary deflection magnetic field substantially antisymmetric about the Y-Z plane including the Y- and Z-axes and mainly composed of a vertical component.

DETAILED DESCRIPTION OF THE PREFERRED EMBODIMENT

A horizontal deflection magnetic field to be applied in a cathode ray tube apparatus will be described in detail.

Figure 1A:
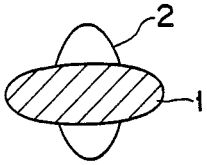
FIG. 1A (PRIOR ART)
FIGS. 1A and 1B are plan views showing the shapes of beam spots, which are formed by deflected electron beams, in end portion areas on a phosphor screen along its horizontal and vertical axes in a conventional color picture tube.
Figure 1B:
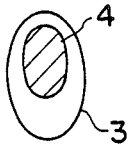
FIG. 1B (PRIOR ART)
Figure 2A:
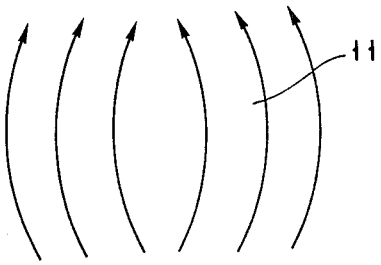
FIGS. 2A and 2B are plan views showing the distributions of main and auxiliary horizontal deflection magnetic fields generated by a horizontal deflection yoke in a cathode ray tube apparatus according to the present invention.
Figure 2B:
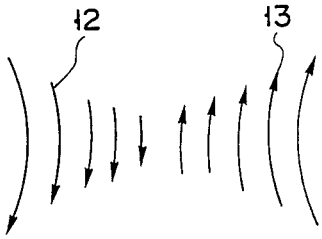
Figure 3A:
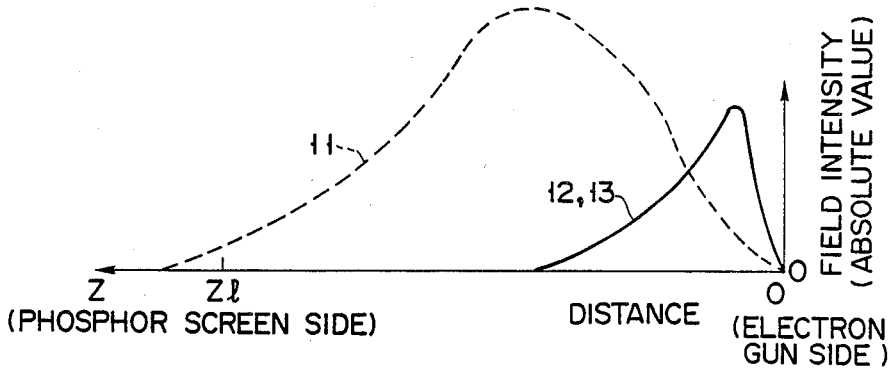
FIGS. 3A, 3B, and 3C are graphs respectively showing a relationship between the main and auxiliary horizontal magnetic fields.

In the cathode ray tube apparatus according to the present invention, a horizontal deflection magnetic field composed of barrel-shaped main horizontal deflection magnetic field 11 shown in FIG. 2A and antisymmetrically shaped auxiliary deflection magnetic fields 12 and 13 shown in FIG. 2B is generated. Main and auxiliary horizontal deflection magnetic fields 11 12, and 13 shown in FIGS. 2A and 2B have the intensity distributions along tube axis Z of the cathode ray tube, as shown in FIG. 3A. As is apparent from FIG. 3A, the intensity of the main horizontal deflection magnetic field reaches its peak value near the phosphor screen, whereas that of the auxiliary deflection magnetic field reaches its peak value near the electron gun assembly. Note that the axis of abscissa in FIG. 3A represents a relative distance from reference position O, e.g., an end of the electron gun assembly on the phosphor screen side, to a given position along the Z-axis toward the phosphor screen.

Generally, the intensity Bx of a magnetic field symmetrical about the Y-Z plane can be given as:

$$Bx=B_0+B_2\cdot x^2+B_4\cdot x^4+\ldots \quad (1)$$

where $B_o$, $B_2$ and $B_4$ are coefficients of the terms for respectively representing the intensities of the symmetrical magnetic field components and x is the value of x-coordinate. The most important character of horizontal deflection magnetic field depends on $B_2$, which is a secondary component.

The intensity $B_y$ a magnetic field antisymmetrical about the Y-Z plane can be given as:

$$B_y=B_1x+B_3x^3+B_5\cdot x^5+\ldots \quad (2)$$

where $B_1$, $B_3$, and $B_5$ are coefficients of the terms for respectively representing the intensities of the antisymmetrical magnetic field components and X is also the value of X-coordinates. The auxiliary horizontal deflection magnetic field mainly depends on $B_1$, which is a primary component. It is found from these equations that the intensity distributions of the main and auxiliary horizontal deflection magnetic fields shown in FIGS. 3A correspond to secondary and primary components $B_2$ and $B_1$, respectively.

Figure 3B:
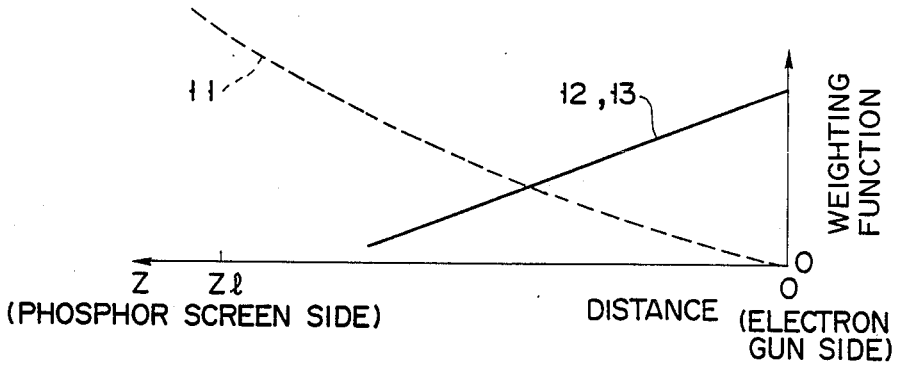

FIG. 3B shows the weighting function related to the influences of main and auxiliary horizontal magnetic fields 11, and 12 and 13 in FIG. 3A upon convergence of electron beams and the shapes of beam spots. As shown in FIG. 3B, the weighting function of the main horizontal deflection magnetic field indicated by a broken line has a large value on the phosphor screen side, whereas that of the auxiliary deflection magnetic field indicated by a solid line has a large value on the electron gun assembly side.

Figure 3C:
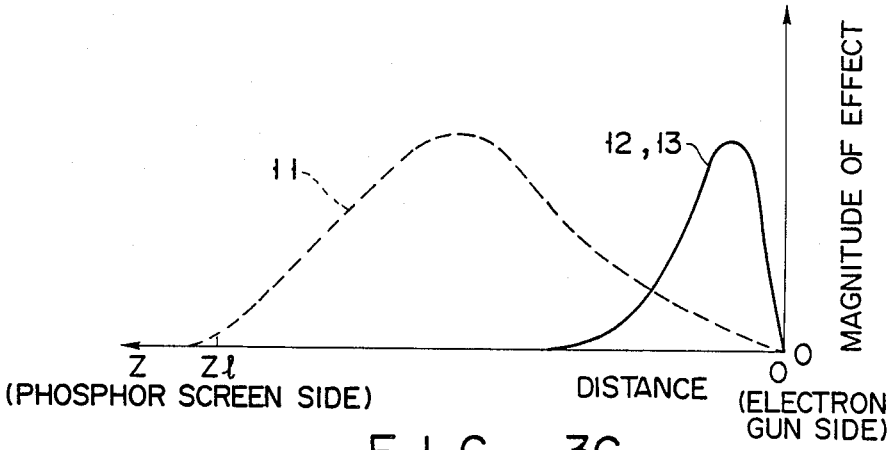

As shown in FIG. 3C, the influences of the deflection magnetic fields to be applied upon electron beams are proportional to the product of the intensity of the magnetic field in FIG. 3A and the weighting function in FIG. 3B.

It is found from the above description that in the present invention, electron beams propagating from the electron gun assembly toward the phosphor screen are influenced by the auxiliary deflection magnetic fields and then by the main horizontal deflection magnetic field.

The convergence of electron beams and the shapes of beam spots formed on the screen in the present invention will be described on the basis of the analysis described above with reference to FIGS. 4A, 4B, 5A, 5B, 6A, and 6B.

Figure 4A:
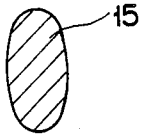
FIGS. 4A and 4B, and FIGS. 5A and 5B are views illustrating states wherein shapes and convergence of electron beams generated by the horizontal deflection magnetic field and magnetic field correcting elements are changed.
Figure 4B:
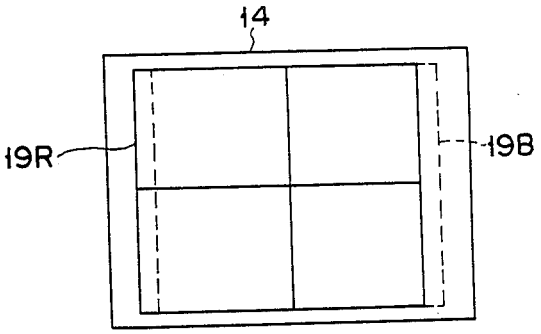

If, for example, only main deflection magnetic field 11 is applied to electron beams radiated from the electron gun assembly, since the electron beams deflected toward an end portion on the phosphor screen along the horizontal axis are influenced by the main deflection magnetic field, a beam spot composed of only vertically elongated core portion 15, from which a halo portion is eliminated, is formed on screen 14, as shown in FIG. 4A. However, the three electron beams are slightly overconverged. Therefore, as shown in FIG. 4B, in rectangular phosphor screen 14, landing area 19R indicated by a solid line, onto which a red side electron beam is landed, and landing area 19B indicated by broken lines, onto which a blue side electron beam is landed, do not coincide with each other, and the landing areas formed on phosphor screen 14 are shifted from each other.

Figure 5A:
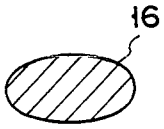
Figure 5B:
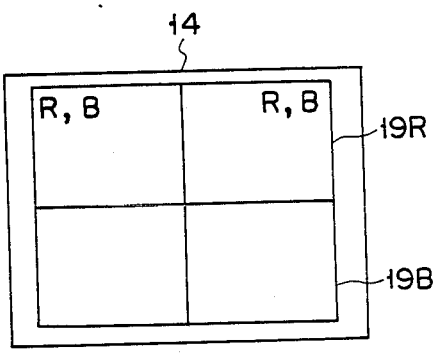

In contrast to the above case, when auxiliary deflection magnetic fields 12 and 13 shown in FIG. 2B are applied to the electron beams, a beam spot composed of horizontally elongated core portion 16 with a small halo portion is formed into a shape which does not pose any problem in a practical use, as shown in FIG. 5B. In addition, as for the convergence of the three electron beams, an excellent convergence characteristic can be obtained, wherein the landing areas on which the electron beams on both the sides are landed coincide with each other, as shown in FIG. 5B. This is because the auxiliary and main deflection magnetic fields influence the electron beams so as to further elongate the sectional area thereof in the horizontal and vertical direction, respectively. In this case, since the influence of the auxiliary deflection magnetic fields is stronger than that of the main deflection magnetic field, the shape of the electron beams is slightly elongated in the horizontal direction at the end. As described above, when the electron beams are influenced by the auxiliary deflection magnetic fields and enter a domain of the main horizontal deflection magnetic field, the shape of the electron beams is influenced by a barrel magnetic field and becomes closer to a circle.

As described above, according to the present invention, an in-line type color picture tube can be realized, in which an excellent shape of each electron beam spot can be obtained on the phosphor screen and an excellent convergence characteristic of the three electron beams can be obtained.

An embodiment arranged by combining the above-described horizontal deflection magnetic fields and magnetic field correcting elements will be described with reference to FIGS. 6A, 6B, 7A, and 7B.

Figure 6A:
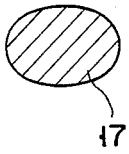
FIGS. 6A and 6B are views illustrating the shape and convergence of an electron beam when the magnetic field correcting element is used.
Figure 6B:
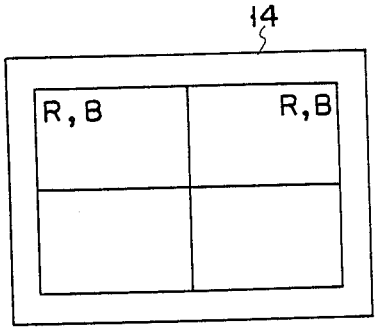

When magnetic field correcting elements each consisting of a high-permeability magnetic material are arranged to be close to the electron beams in the auxiliary horizontal magnetic fields, the horizontally deflected beams constitute a beam spot having core portion 17 slightly elongated in the horizontal direction and a very small halo portion on phosphor screen 14, as shown in FIG. 6A. In addition, as for the convergence of the three electron beams, a good convergence characteristic can be obtained, wherein the electron beams on both the sides substantially identical with each other. Magnetic field correcting elements allowing such a characteristic will be described with reference to FIGS. 7A and 7B.

Figure 7A:
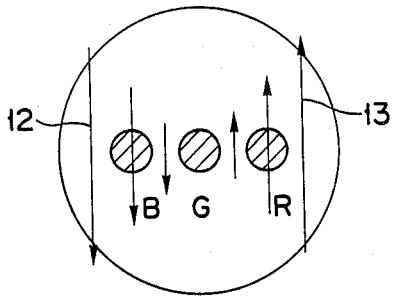
FIGS. 7A and 7B are views for explaining operations of the horizontal deflection magnetic field and the magnetic field correcting elements.
Figure 7B:
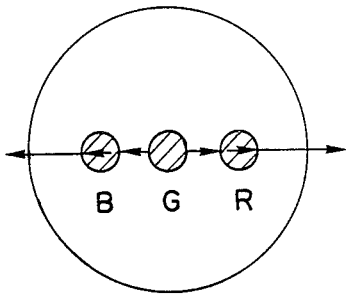

FIG. 7A shows a relationship between electron beams B, G, and R emitted from the electron gun assembly and auxiliary deflection magnetic fields 12 and 13 influencing these electron beams. When the magnetic field correcting elements are not arranged, a magnetic field shown in FIG. 7B is applied to electron beams B, G, and R. More specifically, since magnetic forces indicated by long arrows are applied to the outermost portions of the electron beams, and magnetic forces indicated by short arrows are applied to its innermost portions, the electron beams are influenced by magnetic forces causing the shape of the electron beams to be horizontally elongated.

Figure 7C:
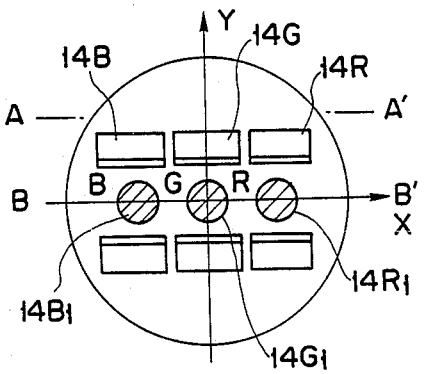
FIG. 7C is a plan view showing an arrangement of magnetic field correcting elements.

When pairs of magnetic field correcting elements 14B, 14G, and 14R are arranged in auxiliary deflection magnetic fields 12 and 13 as shown in FIG. 7C, auxiliary deflection magnetic fields 12 and 13 are made uniform within areas 14B1, 14G1, and 14R1 respectively formed between the pairs of magnetic field correcting elements 14B, 14G, and 14R. As a result, the magnetic components causing the electron beams to be horizontally elongated are reduced, and hence the electron beams passing through these areas are subjected to only a force causing the shape of the sectional area of the beams to be slightly elongated in the horizontal direction.

Figure 8:
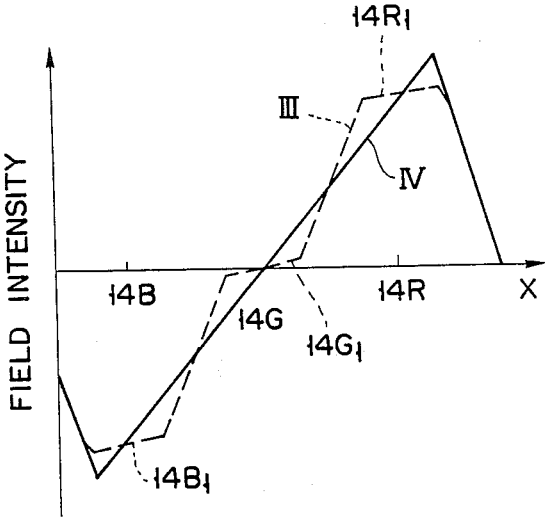
FIG. 8 is a graph showing changes in intensity distribution of the auxiliary deflection magnetic field due to the magnetic field correcting elements in FIG. 7C.

FIG. 8 shows the intensity distributions of the magnetic fields along the X-axis in the space shown in FIG. 7C. Referring to FIG. 8, broken line III represents the distribution of the magnetic field intensity (the axis of ordinate) along line B—B' passing through areas 14B1, 14G1, and 14R1 between the respective pairs of 14B, 14G, add 14R, which coincide with the X-axis, and line IV represents the distribution of the magnetic field intensity (the axis of ordinate) along line A—A' parallel to the X-axis. As shown in FIG. 8, the magnetic field intensities are made uniform within areas 14B1, 14G1, and 14R1 between the respective pairs of magnetic field correcting elements 14B, 14G, and 14R. Therefore, distortion of the three electron beams passing through these areas can be prevented.

As described above, when the electron beams are influenced by the auxiliary deflection magnetic fields and enter the domain of the main horizontal deflection magnetic field, the shapes of the electron beams are influenced by the barrel magnetic field and becomes closer to a circle.

Accordingly, by arranging the magnetic field correcting elements in the auxiliary horizontal deflection magnetic fields, an in-line type color picture tube can be realized, wherein the shape of each electron beam spot on the phosphor screen has a more preferable shape and a good convergence characteristic of the electron beams can be obtained.

Figure 9:
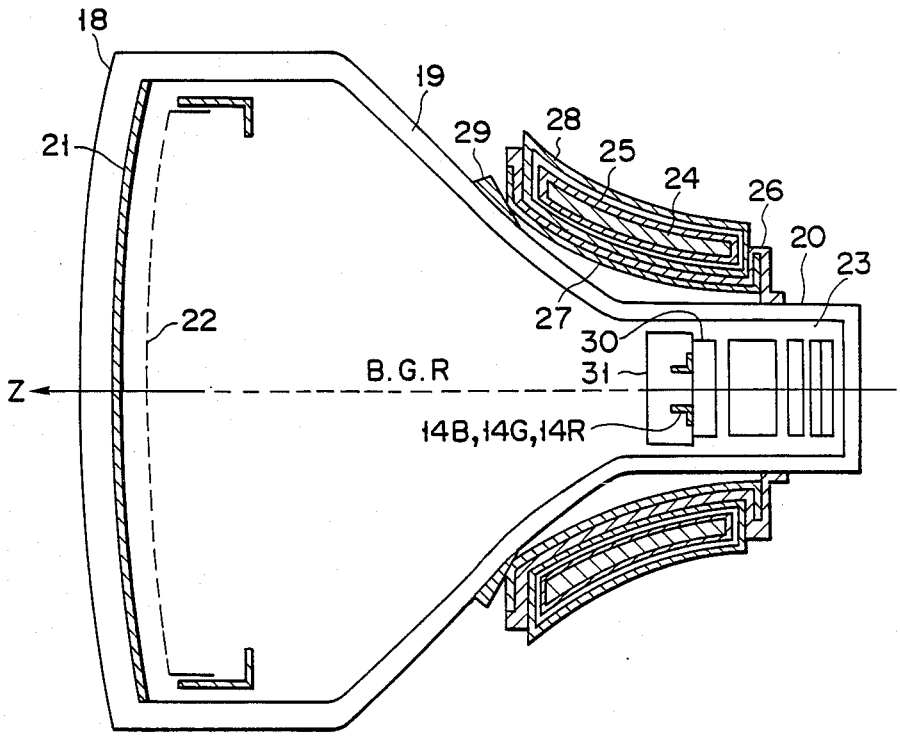
FIG. 9 is a schematic sectional view of a color cathode ray tube apparatus according to an embodiment of the present invention.

FIG. 9 is a schematic view of a color cathode ray tube apparatus incorporating a deflection yoke for generating the main and auxiliary horizontal deflection magnetic fields shown in FIGS. 2A and 2B. As is well known, an envelope comprises panel 1B, funnel 19, and neck 20. Red, green, and blue phosphor dots or stripes are regularly deposited on an inner surface of a face-plate of panel 18 to form phosphor screen 21. In-line type electron gun assembly 23 for radiating three electron beams B, G, and R, i.e., a central electron beam and side electron beams, toward phosphor screen 21 is incorporated in neck 20. Electron beams B, G, and R are deflected by a horizontal and vertical deflection magnetic field generators arranged outside funnel 19 and are landed on a display area of phosphor screen 21.

Shadow mask 22 is arranged near phosphor screen 21 to oppose the inner surface of panel 18. Three electron beams B, G, and R pass through a large number of small apertures formed in shadow mask 22 and are landed on predetermined positions on three color phosphors.

The horizontal and vertical deflection magnetic field generators will be described in detail.

For the vertical deflection magnetic field generator, a known device such as toroidal coil 25 wound around ferrite core 24 is employed to generate a barrel magnetic field. The magnetic field generated by the vertical deflection magnetic field generator preferably has a barrel shape, however, may have a uniform shape or a pincushion shape.

As described above, the horizontal deflection magnetic field is formed by combining the main and auxiliary horizontal deflection magnetic fields shown in FIGS. 2A and 2B. The main horizontal deflection magnetic field is generated by coil 27 wound around an inner surface of separator 26 in the form of a saddle, as shown in FIG. 9. The auxiliary horizontal deflection magnetic field is generated by toroidal coil 28 wound around ferrite core 24. Accordingly, vertical deflection coil 25 and auxiliary horizontal deflection coil 28 are wound around ferrite core 24.

Figure 10A:
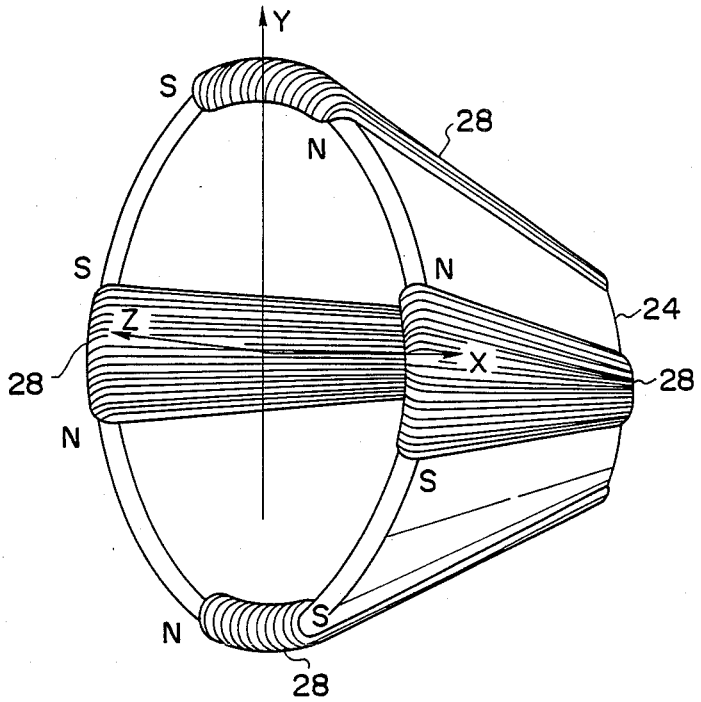
Figure 10B:
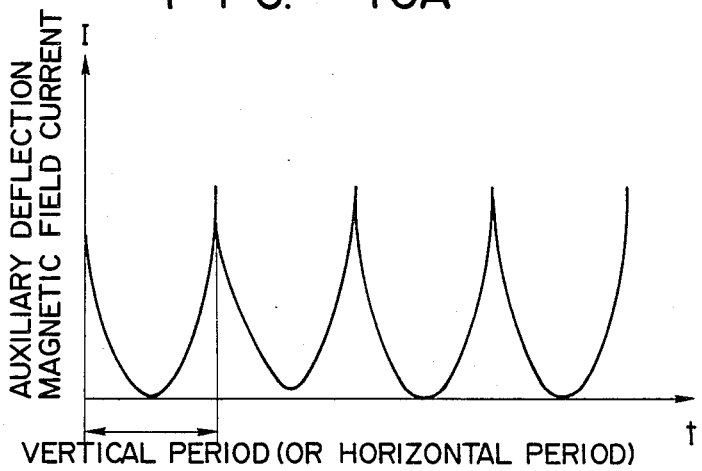
FIG. 10B is a graph showing a current to be supplied to the coil in FIG. 10A.

FIG. 10A is an enlarged view of ferrite core 24 and toroidal coil 28 for generating the auxiliary horizontal deflection magnetic field, from which the vertical deflection coil is omitted. FIG. 10B shows a relationship between a current to be supplied to the toroidal coil in FIG. 10A and time.

As shown in FIG. 10A, the vertical deflection magnetic field generating coil, the main horizontal deflection magnetic field generating coil, and the auxiliary horizontal deflection magnetic field generating coil are combined with each other and adjusted. Then, as shown in FIG. 9, they are mounted around the outer surfaces of the neck and funnel of the color picture tube using wedges 29. In such a color picture tube, when vertical and horizontal deflection signals are respectively supplied to the vertical deflection magnetic field generating coil and the main horizontal deflection magnetic field generating coil, and an auxiliary horizontal deflection signal shown in FIG. 10B is supplied to auxiliary horizontal deflection magnetic field generating coil 28, a vertical deflection magnetic field having a barrel, uniform, or pincushion shape is formed by the vertical deflection magnetic field generating coil, and the main and auxiliary horizontal magnetic fields shown in FIGS. 2A and 2B are formed by the main and auxiliary horizontal magnetic field generating coils. Therefore, even if the electron beams emitted from the electron gun assembly are deflected by these vertical and horizontal deflection magnetic fields in a predetermined manner, distortion of the electron beams can be minimized by the above-described effects. Thus, a color cathode ray tube apparatus having an excellent resolution can be realized.

Figure 11:
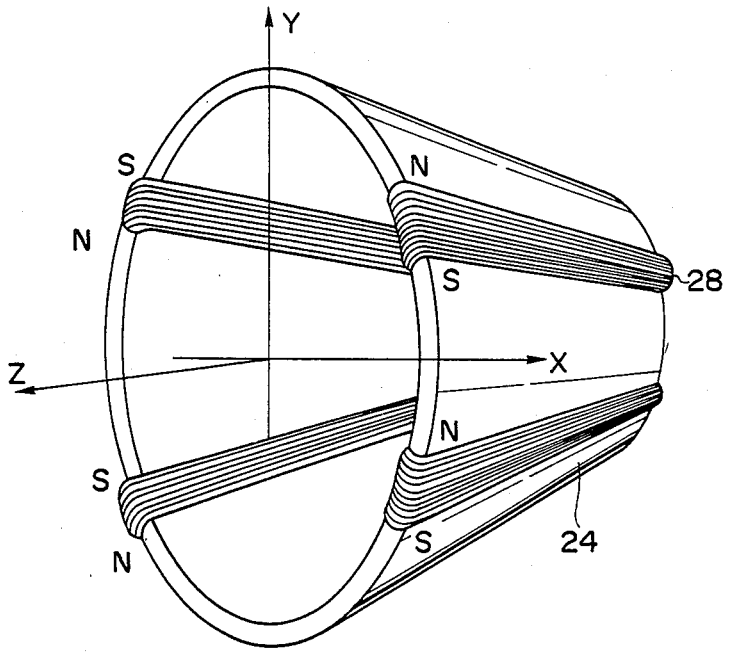
FIGS. 10A, 11, 12, and 14 are perspective views schematically showing the shapes of cores and coils for generating an auxiliary deflection magnetic field used in the embodiment of the present invention.
Figure 12:
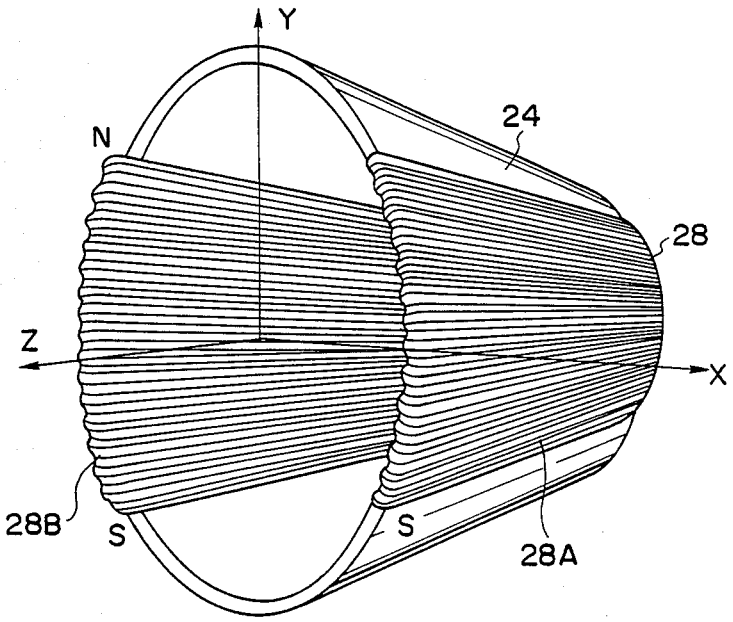

Toroidal coil 28 for generating the auxiliary deflection magnetic field may be wound around ferrite core 24, as shown in FIG. 11 or 12. Coil 28 shown in FIG. 12 is separated into left and right coil sections 28A and 28B. Auxiliary deflection magnetic field currents Ia and Ib respectively indicated by solid and broken lines in FIG. 13 are respectively supplied to right and left coils section 28B and 28A, thereby generating the antisymmetrical auxiliary deflection magnetic fields shown in FIG. 2B.

Figure 13:
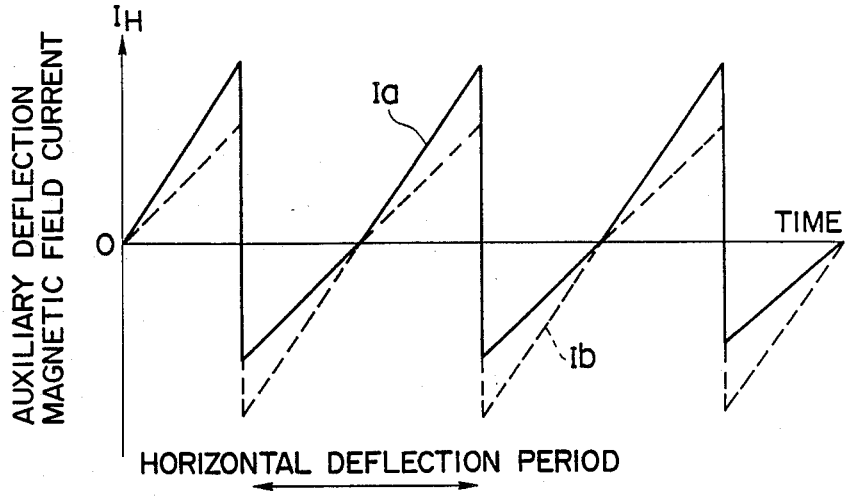
FIG. 13 is a graph showing a current to be supplied to the coil in FIG. 12 or 14.
Figure 14:
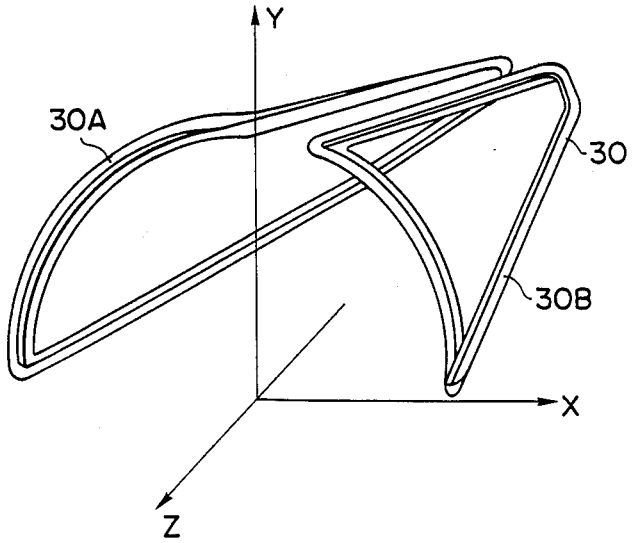

If saddle coil 30 having left and right sections 30A and 30B shown in FIG. 14 is employed and the currents shown in FIG. 13 are respectively supplied to left and right sections 30A and 30B in the same manner as in the above case, auxiliary deflection magnetic fields equivalent to the ones shown in FIG. 2B can be obtained.

When the current shown in FIG. 13 is to be supplied to the coil in FIG. 14, a main horizontal deflection magnetic field and an auxiliary deflection magnetic fields can be generated by a pair of coils. However, the generated magnetic fields have distributions obtained by superposing the main horizontal deflection magnetic field in FIG. 2A on the auxiliary deflection magnetic fields in FIG. 2B. In such a case, the shapes and intensities of the main horizontal deflection magnetic field and the auxiliary deflection magnetic fields can be independently changed by selecting shapes of the coils and the currents to be supplied to the coils.

Practical examples of the magnetic field correcting elements will be described.

Figure 15:
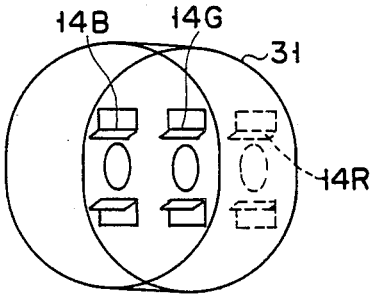
FIGS. 15, 16A, and 16B are perspective views showing various magnetic field correcting elements in the embodiment of the present invention.
Figure 16A:
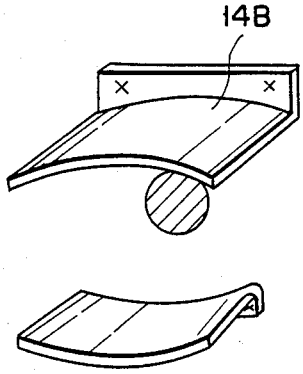
Figure 16B:
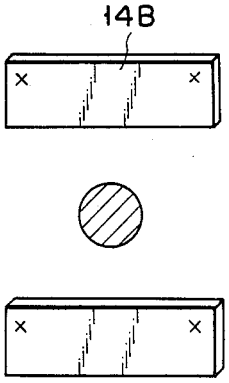

Magnetic field correcting elements are arranged in electron gun assembly 23 near holes formed in shield member 31, which allow the electron beams to pass through, located near one end of the deflection unit. That is, as shown in FIG. 15, magnetic field correcting elements 14B, 14G, and 14R are mounted on cylindrical shield member 31. Each of the magnetic field correcting elements may be made of a high-permeability permalloy or the like, and may be formed into a shape shown in FIG. 16A or 16B. In addition, the magnetic field correcting element may be mounted not only on a final electrode but also on a convergence electrode.

As has been described above, according to the present invention, a color cathode ray tube apparatus can be realized, in which distortion of deflected electron beams is reduced, and excellent resolution can be obtained.

What is claimed is:

1. A color cathode ray tube apparatus comprising:
an evacuated envelope having tube axis Z;
a phosphor screen formed in said envelope, tube axis Z passing through a center of said phosphor screen, and said phosphor screen having horizontal and vertical axes X and Y orthogonal to tube axis Z;
an electron gun assembly which is an in-line type electron gun assembly, arranged in said evacuated envelope, for emitting a central beam, and side beams, toward said phosphor screen, the electron means being landed on said phosphor screen to cause said phosphor screen to emit light rays; and
deflection magnetic field generating means, arranged outside said evacuated envelope, for generating horizontal and vertical deflection magnetic fields inside said envelope so as to horizontally and vertically deflect the electron beams and scan said phosphor screen with the electron beams, the horizontal deflection magnetic filed including a main deflection magnetic field having a barrel-shaped distribution and an auxillary deflection magnetic field, said main deflection magnetic field including a first vertical component formed in the envelope so as to be symmetrical about a Y-Z plane including Y- and Z-axes and extend along the Y-axis, said auxiliary deflection magnetic field being substantially antisymmetric about the Y-Z plane including the Y- and Z-axes and mainly composed of a second vertical component.

2. An apparatus according to claim 1, wherein the auxilliary deflection magnetic field has a peak value of an intensity on an electron gun assembly side, and the main deflection magnetic field has a peak value of an intensity on a phosphor screen side.

3. An apparatus according to claim 1, further comprising means for substantially uniformly forming a magnetic field in a portion of a path through which at least side electron beams pass in a space where the auxiliary deflection magnetic field is formed.

4. An apparatus according to claim 3, wherein said means for substantially uniformly forming the magnetic field is composed of a pair of magnetic segments having high permeability, the side electron beams passing through a region defined between said pair of magnetic segments, and the uniform magnetic field being produced between said pair of magnetic segments.

* * * * *